US009474424B2

(12) United States Patent
Moyher, Jr. et al.

(10) Patent No.: US 9,474,424 B2
(45) Date of Patent: Oct. 25, 2016

(54) SURFACE CLEANING APPARATUS

(71) Applicant: BISSELL Homecare, Inc., Grand Rapids, MI (US)

(72) Inventors: George Moyher, Jr., Cedar Springs, MI (US); Michael Graham, Lake Odessa, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 644 days.

(21) Appl. No.: 13/896,848

(22) Filed: May 17, 2013

(65) Prior Publication Data

US 2013/0318741 A1 Dec. 5, 2013

Related U.S. Application Data

(60) Provisional application No. 61/654,281, filed on Jun. 1, 2012.

(51) Int. Cl.

| | |
|---|---|
| ***A47L 11/29*** | (2006.01) |
| ***A47L 5/36*** | (2006.01) |
| ***A47L 11/34*** | (2006.01) |
| ***A47L 11/40*** | (2006.01) |
| ***A47L 9/00*** | (2006.01) |

(52) U.S. Cl.

CPC ..... *A47L 5/365* (2013.01); *A47L 5/362* (2013.01); *A47L 9/0036* (2013.01); *A47L 9/0045* (2013.01); *A47L 11/34* (2013.01); *A47L 11/4002* (2013.01); *A47L 11/4008* (2013.01); *A47L 11/4016* (2013.01); *A47L 11/4019* (2013.01); *A47L 11/4027* (2013.01); *A47L 11/4075* (2013.01); *A47L 11/4083* (2013.01); *A47L 11/4088* (2013.01)

(58) Field of Classification Search

CPC ..... A47L 5/365; A47L 5/362; A47L 9/0045; A47L 11/4027; A47L 11/4088; A47L 11/4075; A47L 11/4019; A47L 11/4016; A47L 9/0036; A47L 11/4008; A47L 11/34; A47L 11/4002; A47L 11/4083

USPC ..... 15/320, 322, 344

See application file for complete search history.

(56) References Cited

U.S. PATENT DOCUMENTS

| | | | |
|---|---|---|---|
| 5,655,254 | A | 8/1997 | Bores et al. |
| 5,799,362 | A | 9/1998 | Huffman |
| 7,073,226 | B1 | 7/2006 | Lenkiewicz et al. |
| 7,228,589 | B2 | 6/2007 | Miner et al. |
| 7,234,197 | B2 | 6/2007 | Tran |
| 7,784,148 | B2 | 8/2010 | Lenkiwicz et al. |
| 2005/0050670 | A1 | 3/2005 | Kumazaki |
| 2006/0272120 | A1 | 12/2006 | Barrick et al. |
| 2008/0216278 | A1 | 9/2008 | Krebs et al. |

FOREIGN PATENT DOCUMENTS

| | | | |
|---|---|---|---|
| EP | 0545138 | A | 6/1993 |
| WO | 2011100678 | A2 | 8/2011 |

OTHER PUBLICATIONS

A. Eckenschwiller, Partial European Search Report, See Official Journal of the European Patent Office, No. 12/82, Dec. 6, 2013, 5 pages, Munich, Germany.

*Primary Examiner* — David Redding
(74) *Attorney, Agent, or Firm* — McGarry Bair PC

(57) ABSTRACT

A cleaning apparatus for a floor surface comprises a fluid delivery system having a supply tank for storing cleaning fluid and a fluid distributor for delivering the cleaning fluid to a surface to be cleaned. An air pathway is provided in the cleaning apparatus for removing heated air from the motor. In operation, heat from the heated air is transferred to the cleaning fluid in the supply tank.

18 Claims, 11 Drawing Sheets

SURFACE CLEANING APPARATUS

CROSS-REFERENCE TO RELATED APPLICATION

This application claims the benefit of U.S. Provisional Patent Application No. 61/654,281, filed Jun. 1, 2012, which is incorporated herein by reference in its entirety.

BACKGROUND OF THE INVENTION

Extractors are well-known surface cleaning devices for deep cleaning carpets and other fabric surfaces, such as upholstery. Most carpet extractors comprise a fluid delivery system and a fluid recovery system. The fluid delivery system typically includes one or more fluid supply tanks for storing a supply of cleaning fluid, a fluid distributor for applying the cleaning fluid to the surface to be cleaned, and a fluid supply conduit for delivering the cleaning fluid from the fluid supply tank to the fluid distributor. The fluid recovery system usually comprises a recovery tank, a nozzle adjacent the surface to be cleaned and in fluid communication with the recovery tank through a conduit, and a source of suction in fluid communication with the conduit to draw the cleaning fluid from the surface to be cleaned and through the nozzle and the conduit to the recovery tank.

Portable extractors can be adapted to be hand-carried by a user. An example of a portable extractor is disclosed in commonly assigned U.S. Pat. No. 7,073,226 to Lenkiewicz et al., which is incorporated herein by reference in its entirety.

SUMMARY OF THE INVENTION

According to one aspect of the invention, a surface cleaning apparatus for cleaning a surface comprises a housing at least partially defining an air pathway, a fluid delivery system having a supply tank provided with the housing for storing cleaning fluid and a fluid distributor for delivering the cleaning fluid from the supply tank to the surface, a motor/fan assembly provided within the air pathway for generating an airflow through the pathway wherein the motor/fan assembly transfers heat to air moving through the pathway and removes heated air from the air pathway, the air pathway having an inlet upstream of the motor/fan assembly and an outlet downstream of the motor/fan assembly, and a duct downstream of the motor/fan assembly and upstream of the outlet and having a section in heat exchange relationship with the supply tank, with the section of the duct having an undulating profile providing an increased surface area in heat exchange relationship with the supply tank to heat the supply of cleaning fluid in the supply tank by heat transfer from the heated air.

BRIEF DESCRIPTION OF THE DRAWINGS

The invention will now be described with respect to the drawings in which.

DESCRIPTION OF EMBODIMENT(S) OF THE INVENTION

The invention relates to a surface cleaning apparatus that delivers cleaning fluid to a surface to be cleaned. In one of its aspects, the invention relates to a portable extraction cleaner that is adapted to be hand carried by a user to carpeted areas for cleaning relatively small areas and extracts cleaning fluid and debris from the surface.

Figure 1:
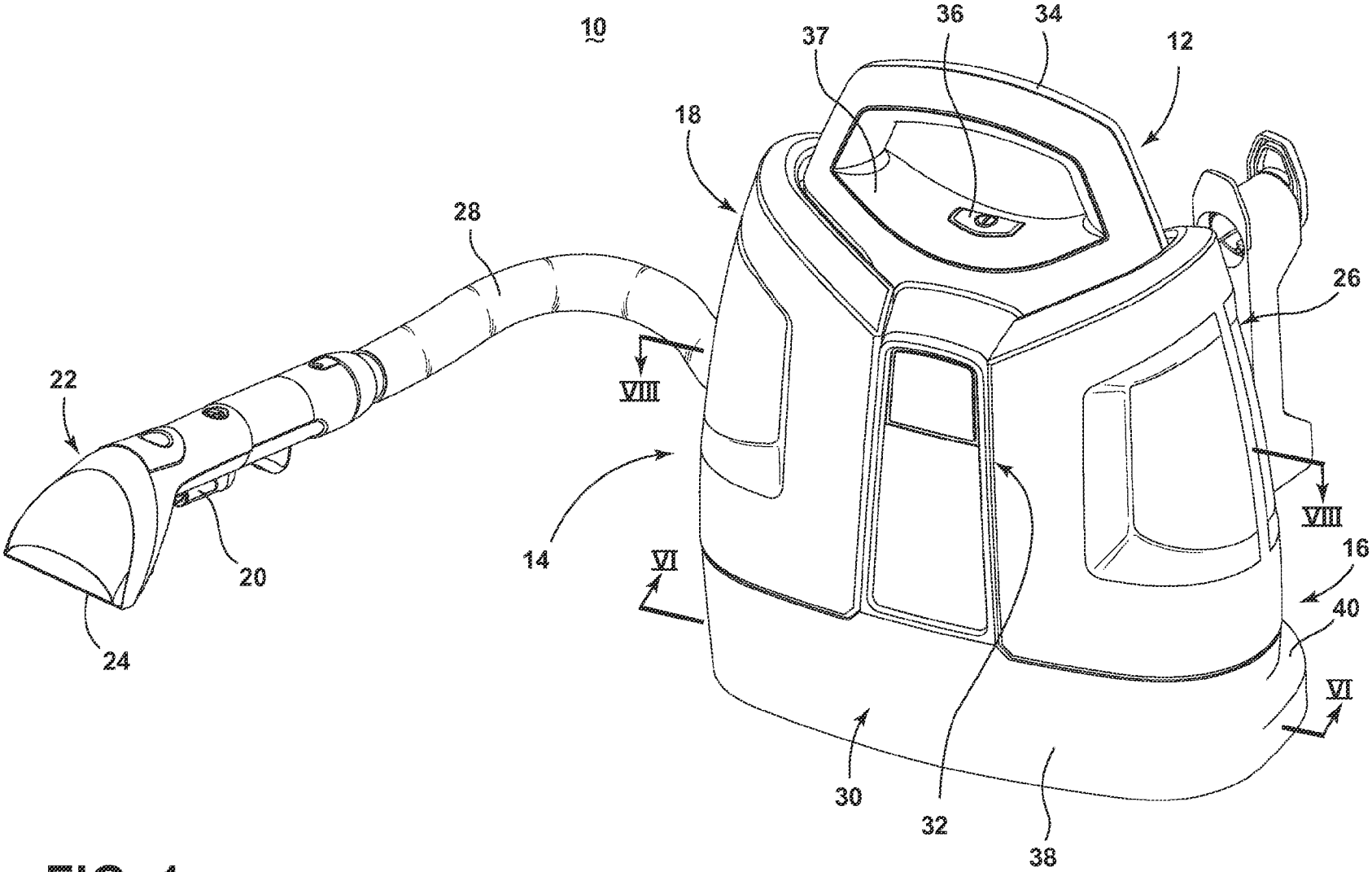
FIG. 1 is a front perspective view of a portable extraction cleaner according to a first embodiment of the invention.

FIG. 1 is a front perspective view of a surface cleaning apparatus in the form of a portable extraction cleaner 10 according to a first embodiment of the invention. The portable extraction cleaner or "extractor" 10 includes a main housing assembly 12 selectively carrying a fluid delivery system 14 for storing cleaning fluid and delivering the cleaning fluid to the surface to be cleaned, and a fluid recovery system 16 for removing the cleaning fluid and debris from the surface to be cleaned and storing the recovered cleaning fluid and debris. The main housing assembly 12 is adapted to selectively mount components of the fluid delivery system 14 and the fluid recovery system 16 to form an easy-to-carry unit that can be transported by a user to different locations with surfaces to be cleaned. While the extractor 10 is illustrated as a portable extraction cleaner, aspects of the invention may be applicable to other types of surface cleaners, including upright extractors having a base assembly for movement across a surface to be cleaned and a handle assembly pivotally mounted to a rearward portion of the base assembly for directing the base assembly across the surface to be cleaned, and surface cleaners which have fluid delivery but not extraction capabilities.

The fluid delivery system 14 can include a fluid supply tank assembly 18 for storing a supply of cleaning fluid and a fluid distributor 20 provided on a hand-held accessory tool 22 in fluid communication with the supply tank assembly 18 for depositing a cleaning fluid onto the surface. Various combinations of optional components can be incorporated into the fluid delivery system 14 such as a conventional fluid pump, a heater, or fluid control and mixing valves as is commonly known in the art.

The fluid recovery system 16 can include an extraction path in the form of an extraction nozzle 24 provided on the accessory tool 22 which is adapted to be used on the surface to be cleaned, a recovery tank assembly 26, and a flexible vacuum or suction hose 28 in fluid communication with the extraction nozzle 24 and the recovery tank assembly 26.

The main housing assembly 12 comprises a base housing 30 and a partition housing 32 extending upwardly from the base housing 30. In a preferred embodiment, main housing assembly 12 is formed of an opaque material, but can be formed of a translucent or transparent material. The partition housing 32 includes a carry handle 34 at an upper portion thereof which facilitates carrying the extractor 10 from one location to another. A button 36 can be provided adjacent the carry handle 34 and is operably coupled to one or more electrical components of the extractor 10. A resilient boot seal 37 can be fastened to the recessed area beneath the carry handle 34 to form a flexible barrier that isolates the button 36 and internal electrical components from moisture ingress. The resilient boot seal 37 has been illustrated as being over molded onto the partition housing 32 for exemplary purposes; however, other fastening means are possible such as adhesive or mechanical fasteners, for example.

Figure 2:
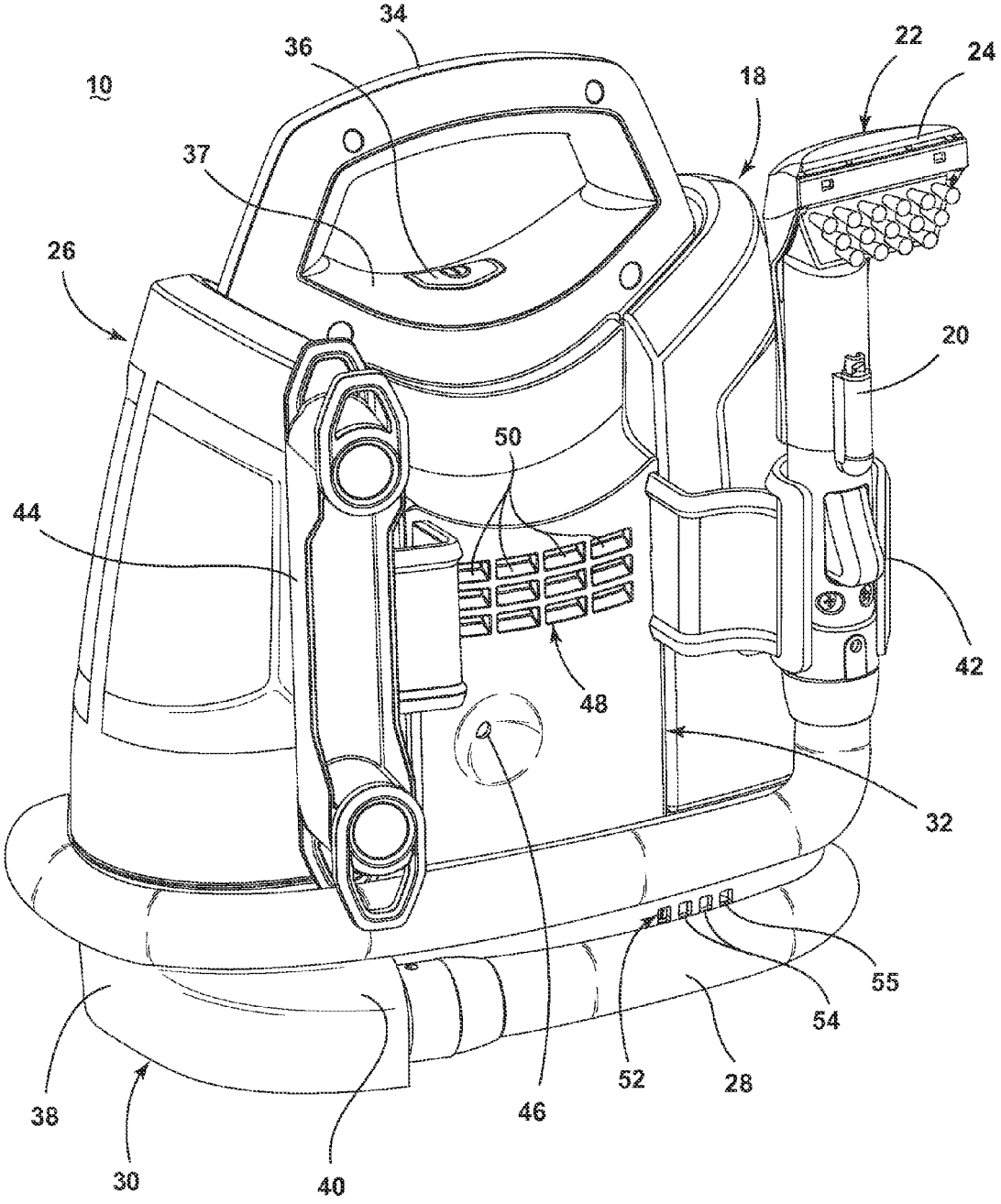
FIG. 2 is a rear perspective view of the portable extraction cleaner from FIG. 1.

FIG. 2 is a rear perspective view of the extractor 10 from FIG. 1. The base housing 30 includes a skirt 38 having a suction hose rest 40 on one end thereof adapted to receive the suction hose 28 when it is wrapped around the skirt 38 for storage, as shown in FIG. 2. A tool retaining bracket 42 can extend from the partition housing 32 and is adapted to retain the accessory tool 22 attached to the suction hose 28 when the suction hose 28 is wrapped around the skirt 38. A cord wrap caddy 44 can be provided on a side of the partition housing 32 for storing a power cord (not shown) which emerges from the interior of the partition housing 32 through a cord aperture 46 can be used to provide power to electrical components of the extraction cleaner 10 from a source of power, such as a home power supply, upon actuation of the button 36. Alternatively, the extraction cleaner 10 can be powered by a portable power supply, such as a battery, upon actuation of the button.

An inlet 48 for a motor-cooling air pathway is provided in the base housing 30 and is illustrated as including a plurality of inlet openings 50 formed in the partition housing 32 between the tool retaining bracket 42 and the cord wrap caddy 44. An outlet 52 for the motor-cooling air pathway is also provided in the base housing 30 and is illustrated as including a plurality of outlet openings 54 formed in the skirt 38 of the partition housing 32, in the area underneath the supply tank assembly 18. An inlet opening 55 for a pump-cooling air pathway is also provided in the base housing 30 and is also formed in the skirt 38 of the partition housing 32, in the area underneath the supply tank assembly 18. The pump-cooling air can be drawn in through the inlet opening 55, into an electrical portion of the pump assembly 176 (FIG. 6) and can be exhausted through an exhaust fitting (not shown) and tube (not shown) that fluidly connect the pump-cooling air path to the extraction path, upstream from a suction source, such as a motor/fan assembly 172.

Figure 3:
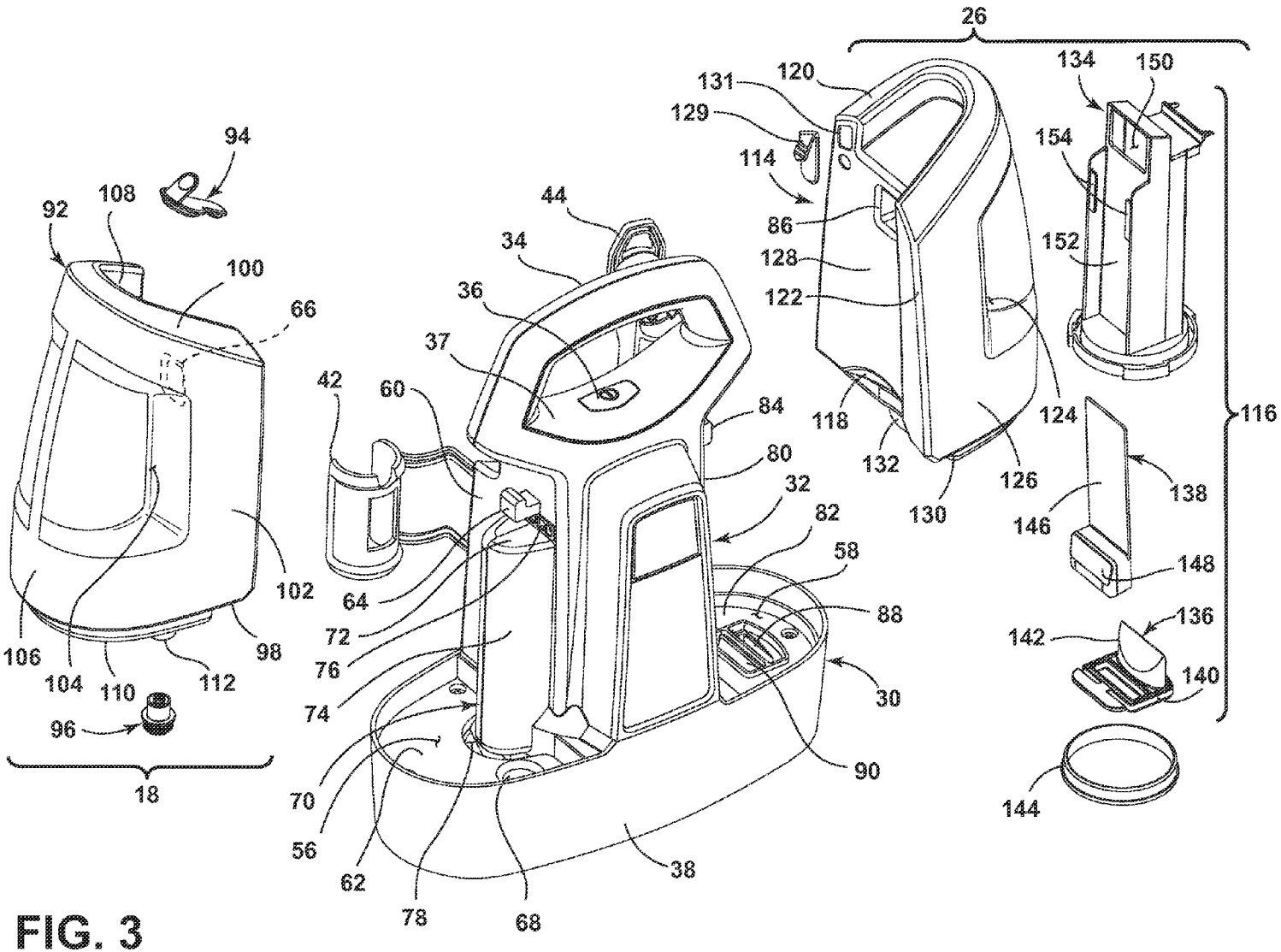
FIG. 3 is a partially-exploded view of the portable extraction cleaner from FIG. 1, showing a supply tank assembly and a recovery tank assembly exploded from a main housing assembly.

FIG. 3 is a partially-exploded view of the extractor 10 from FIG. 1. The base housing 30 and partition housing 32 collectively define opposing tank receivers 56, 58 for respectively receiving the supply tank assembly 18 and recovery tank assembly 26. The supply tank receiver 56 includes a portion of the skirt 38, a first side wall 60 of the partition housing 32, and a first platform 62 defined between the skirt 38 and the partition housing 32. The supply tank receiver 56 further includes a hanger 64 protruding from the first side wall 60 which is fitted into a corresponding socket 66 formed in the supply tank assembly 18 when the supply tank assembly 18 is seated within the supply tank receiver 56. A valve seat 68 is formed in the first platform 62 for fluidly coupling with the supply tank assembly 18 when it is seated within the supply tank receiver 56.

The first side wall 60 of the partition housing 32 further includes a semi-circular protrusion 70 having a top wall 72 and an arcuate side wall 74. A vent 76 is formed in the first side wall 60 above top wall 72 by multiple openings, and a semi-circular air passage 78 is formed in the first platform 62 at the bottom end of the arcuate side wall 74.

The recovery tank receiver 58 includes a portion of the skirt 38, a second side wall 80 of the partition housing 32, and a second platform 82 defined between the skirt 38 and the partition housing 32. The recovery tank receiver 58 further includes a hanger 84 protruding from the second side wall 80 which is fitted into a corresponding socket 86 formed in the recovery tank assembly 26 when the recovery tank assembly 26 is seated within the recovery tank receiver 58. A liquid port 88 and a suction port 90 are formed in the second platform 82 for fluidly coupling with the recovery tank assembly 26 when it is seated within the recovery tank receiver 58.

The supply tank assembly 18 can include a supply tank 92, a fill closure 94, and a valve assembly 96. The supply tank 92 can have a recessed lower portion 98, a recessed upper portion 100, and a peripheral side wall 102 joining the upper and lower portions 98, 100. The side wall 102 can include integrally molded handgrip indentations 104, which facilitates removing and carrying the supply tank 92. The supply tank 92 can be formed of a transparent or tinted translucent material, which permits a user to view the contents of the tank 92.

The side wall 102 can include an externally-facing surface 106, which forms an external surface of the extractor 10 when the supply tank 92 is seated in the supply tank receiver 56 and an internally-facing surface 108, which is internal to the extractor 10 when the supply tank 92 is seated in supply tank receiver 56. The handgrip indentations 104 can be formed in the externally-facing surface 106 and the socket 66 can be formed in the internally-facing surface 108.

The recessed lower portion 98 can include a lower 110 surface adapted to rest on the first platform 62 of the base housing 30 and a hollow neck 112 protruding from the lower surface 110 that defines an outlet of the supply tank 92 which receives the valve assembly 96. The valve assembly 96 is adapted to move to a closed position to seal the outlet of the supply tank 92 when the supply tank 92 is removed from the base housing 30. When the supply tank 92 is seated in the supply tank receiver 56, the neck 112 is at least partially received within the valve seat 68 and the valve assembly 96 is adapted to automatically move to an open position to open the outlet of the supply tank 92.

The recovery tank assembly 26 can include a recovery tank 114 and an air/liquid separator assembly 116. The recovery tank 114 can have a recessed lower portion 118, a recessed upper portion 120, and a side wall 122 joining the upper and lower portions 118, 120. The side wall 122 can include integrally molded handgrip indentations 124, which facilitates removing and carrying the recovery tank 114. The recovery tank 114 can be formed of a transparent or tinted translucent material, which permits a user to view the contents of the tank 114.

The sidewall 122 can include an externally-facing surface 126, which forms an external surface of the extractor 10 when the recovery tank 114 is seated in the recovery tank receiver 58 and an internally-facing surface 128, which is internal to the extractor 10 when the recovery tank 114 is seated in recovery tank receiver 58. The handgrip indentations 124 can be formed in the externally-facing surface 126 and the socket 86 can be formed in the internally-facing surface 128. The recovery tank 114 can further include a closure 129 selectively closing an emptying port 131 in the recovery tank 114. The closure 129 can be made from a flexible material, which permits easy assembly with the recovery tank 114 and easy opening and closing of the port 131 for emptying the recovery tank 114.

The recessed lower portion 118 can include a lower surface 130 adapted to rest on the second platform 82 of the base housing 30 and neck 132 protruding from the lower surface 130 and defining an opening which receives the air/liquid separator assembly 116.

The air/liquid separator assembly 116 comprises a riser tube 134 for guiding air and liquid through the recovery tank 114, a sealing assembly 136, and a float assembly 138 for selectively closing the suction path through the recovery tank 114. The sealing assembly 136 provides a fluid-tight interface between the recovery tank assembly 26 and the liquid and suction ports 88, 90 when the recovery tank assembly 26 is mounted within the recovery tank receiver 58, and also prevents the recovery tank 114 from leaking when removed from the main housing assembly 12.

The sealing assembly 136 includes a gasket 140 on the lower end of the riser tube 134 which mates with the liquid and suction ports 88, 90 when the recovery tank 114 is mounted to the recovery tank receiver 58, and a backflow preventer in the form of a duckbill valve 142 which prevents the escape of fluid drawn into the air/liquid separator assembly 116 from the recovery tank 114. As a suction force is generated within the recovery tank 114, the apex of the duckbill valve 142 separates to allow fluid to pass through the valve 142. When this force is removed, the valve 142 is naturally biased closed and prevents backflow of liquid. An annular gasket 144 is provided for maintaining a fluid-tight interface between the lower end of the riser tube 134 and the recovery tank 114 when the riser tube 134 is mounted therein.

The float assembly 138 includes float shutter 146 and a float body 148 provided on the float shutter 146 for selectively raising the float shutter 146 to a closed position in which the float shutter 146 closes an air inlet port 150 of the riser tube 134. The float shutter 146 slides within a guide passage 152 provided on the riser tube 134, and is retained therein by opposing projections 154, with the float body 148 facing away from the guide passage 152. As the liquid level recovery tank 114 rises, the float body 148 raises the float shutter to close the air inlet port 150 to prevent liquid from entering the suction source of the extractor 10.

Figure 4:
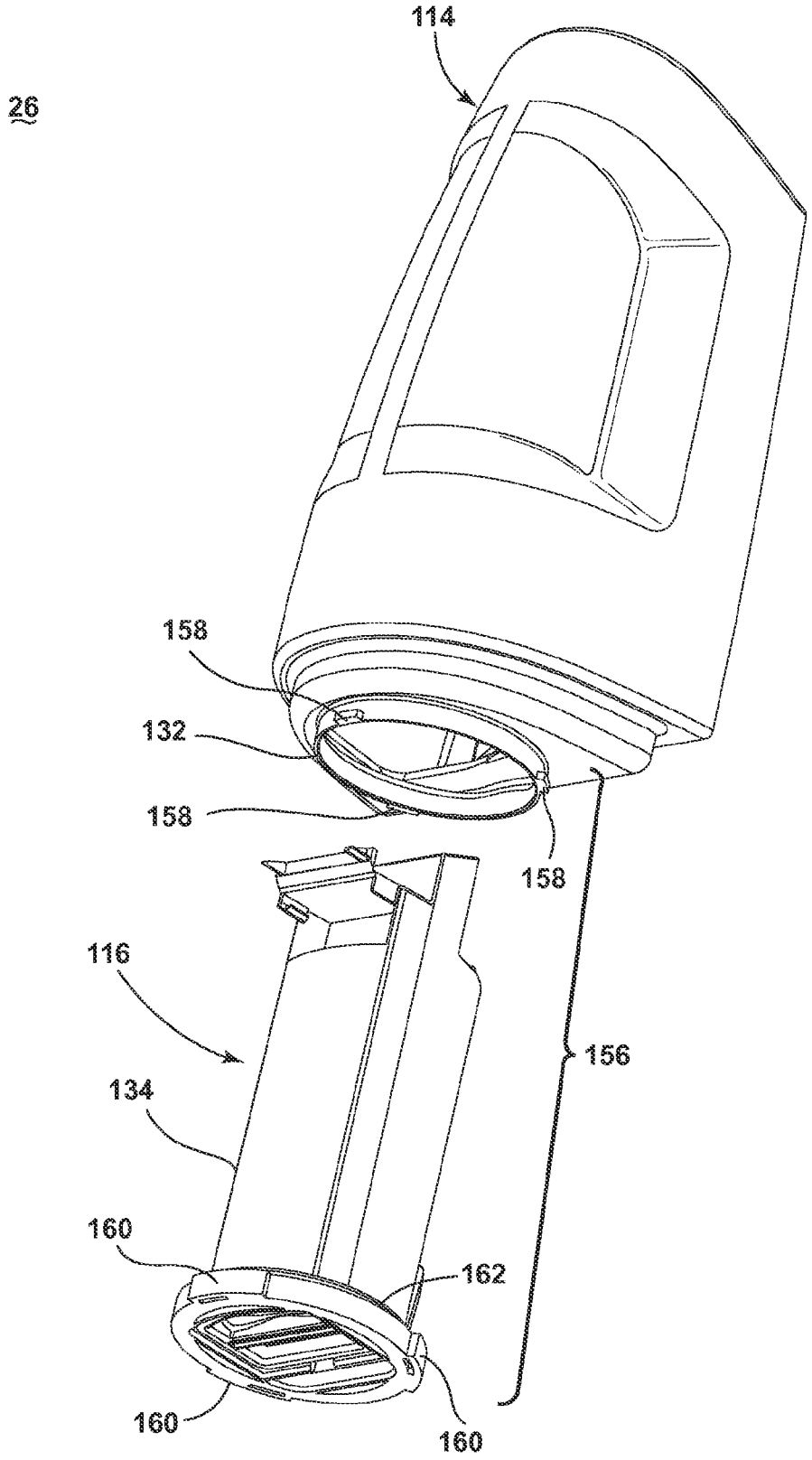
FIG. 4 is a partially-exploded view of the recovery tank assembly from FIG. 3, showing an air/liquid separator assembly exploded from a recovery tank.

FIG. 4 is a partially-exploded view of the recovery tank assembly 26. The air/liquid separator assembly 116 is configured to be easily removable from the recovery tank 114 by a user. This permits the recovery tank 114 to be emptied, and both the recovery tank 114 and the air/liquid separator assembly 116 to be disassembled and cleaned more thoroughly as needed. A mechanical coupling between the recovery tank 114 and the air/liquid separator assembly 116 can be provided for facilitating easy separation of the two components. As shown herein, the mechanical coupling comprises a bayonet interface 156 between the recovery tank 114 and the air/liquid separator assembly 116.

The bayonet interface 156 includes one or more radial pins 158 provided on the neck 132 of the recovery tank 114 and one or more corresponding slots 160 provided on a rim 162 at the lower end of the riser tube 134. As shown herein, three equally-spaced pins 158 are provided, and are generally rectangular in shape. Three equally-spaced corresponding slots 160 are also provided, and are generally configured to receive the pins 158.

Figure 5B:
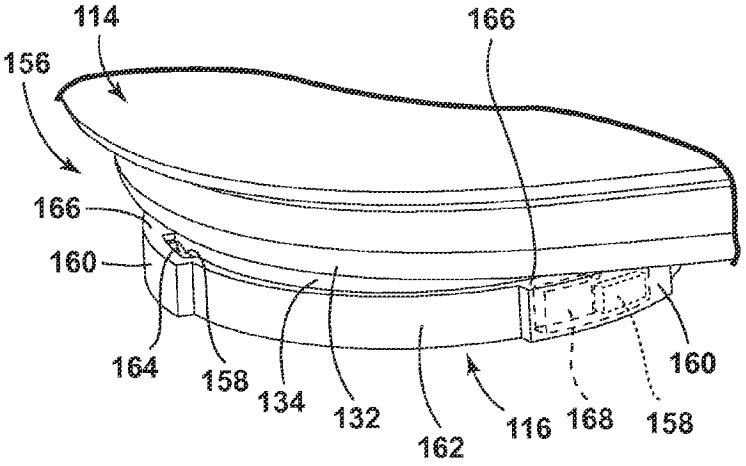
FIG. 5A-C illustrate a procedure for coupling the air/liquid separator assembly and the recovery tank from FIG. 4.
Figure 5A:
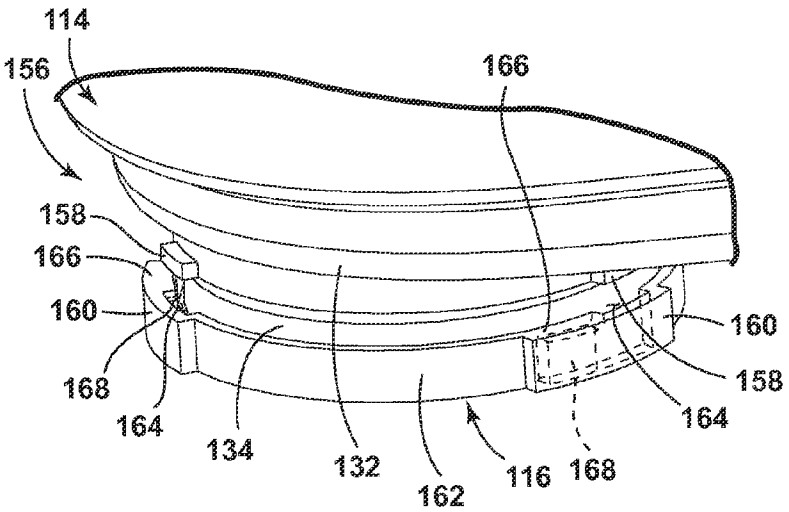
Figure 5C:
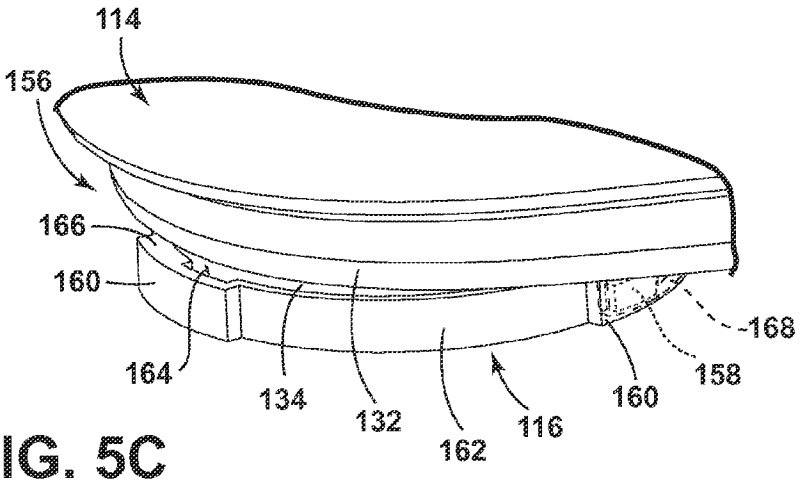

FIGS. 5A-C illustrate a procedure for coupling the air/liquid separator assembly 116 and the recovery tank 114 via the bayonet interface 156 from FIG. 4. The slots 160 each include a slot opening 164 provided on an upper side 166 of the rim 162, and a closed slot passage 168 extending from the slot openings 164 underneath the upper side 166. To couple the air/liquid separator assembly 116 to the recovery tank 114, the pins 158 on the neck 132 are aligned with the slot openings 164 on the riser tube 134, as shown in FIG. 5A. The air/liquid separator assembly 116 and the recovery tank 114 are then pushed together to seat the pins 158 in the slot openings 164, as shown in FIG. 5B. The air/liquid separator assembly 116 and the recovery tank 114 are then rotated relative to each other so that the pins 158 slide into the slot passages 168, as shown in FIG. 5C.

Variations of the bayonet interface 156, such as of the shape of the pins/slots, the number of pins/slots, are possible while still maintaining an easy connection interface. To prevent misassembly by a user, the pins 158 and slots 160 can be positioned around the neck 132 and rim 162 in an irregular pattern to ensure that the air/liquid separator assembly 116 can be assembled to the recovery tank 114 in a single orientation only. Furthermore, the location of the pins 158 and slots 160 can be reversed, i.e. the pins 158 can be provided in the air/liquid separator assembly 116 and the slots 160 can be provided on the recovery tank 114. Other types of mechanical couplings can also be used between the recovery tank 114 and the air/liquid separator assembly 116, including, but not limited to, a threaded couplings, a keyed couplings, and other quick coupling mechanisms.

Figure 6:
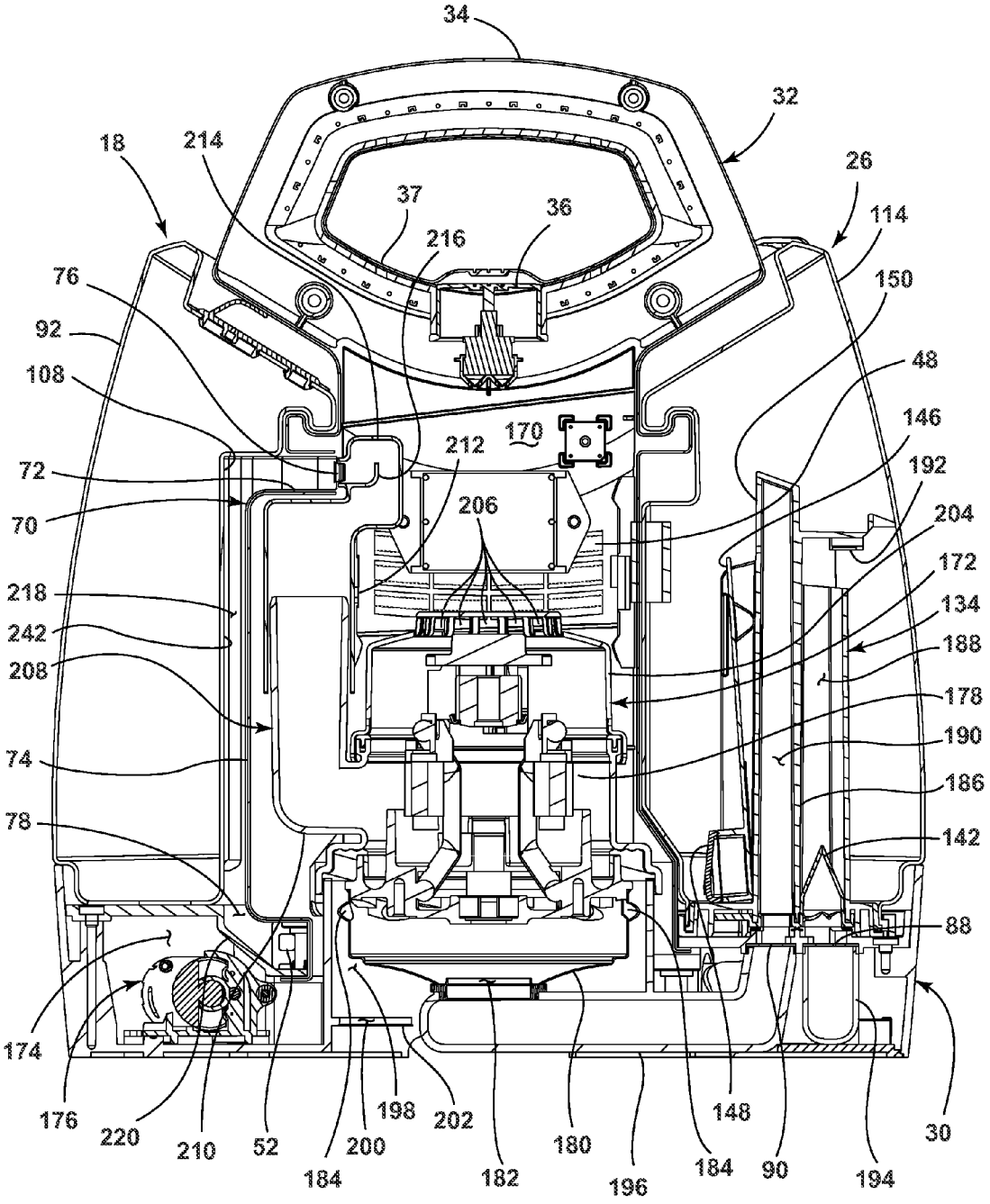
FIG. 6 is a cross-sectional view of the portable extraction cleaner through line VI-VI of FIG. 1.

FIG. 6 is a cross-sectional view of the extractor 10 through line VI-VI of FIG. 1. The partition housing 32 can define one or more internal chambers for receiving components of the extractor 10, including a suction source chamber 170 for receiving a suction source, such as a motor/fan assembly 172 and a pump chamber 174 for receiving the pump assembly 176. The motor/fan assembly 172 can be considered part of the fluid recovery system 16 and is in fluid communication with the recovery tank assembly 26 and is configured to generate a working airflow to draw liquid and entrained debris through the accessory tool 22 and the suction hose 28 (FIG. 1). The motor/fan assembly 172 includes a suction motor 178 with an attached impeller assembly 180 having an impeller inlet 182 and at least one impeller outlet 184. The pump assembly 176 can be considered part of the fluid supply system 14 and is in fluid communication with the supply tank assembly 18 and is configured to supply fluid from the supply tank assembly 18 to the accessory tool 22 (FIG. 1).

The riser tube 134 of the recovery tank assembly 26 has an internal divider 186 dividing the tube 134 into two fluidly isolated conduits, a liquid conduit 188 and an air conduit 190. The liquid conduit 188 is open to the liquid port 88 in the base housing 30 and receives the duckbill valve 142 in the bottom end of the riser tube 134. A liquid outlet port 192 of the liquid conduit 188 opens into the interior of the recovery tank 114 formed in the upper end of the riser tube 134.

The air conduit 190 is open to the suction port 90 in the base housing 30, and includes the air inlet port 150 formed in an upper end of the riser tube 134. The air inlet port 150 is configured to be closed by the float shutter 146 as the liquid level in the recovery tank 114 rises to prevent liquid from entering the motor/fan assembly 172.

A recovery inlet conduit 194 extends at least partially through the base housing 30 and fluidly communicates the recovery tank assembly 26 with the suction hose 28 via the liquid port 88 and the liquid conduit 188. A recovery outlet conduit 196 also extends through the base housing 30, and fluidly communicates the recovery tank assembly 26 with the impeller inlet 182 via the air conduit 190 and suction port 90. An exhaust passage 198 is fluidly formed between the impeller outlet(s) 184 and an exhaust outlet 200 formed in a bottom wall 202 of the base housing 30. The exhaust outlet 200 can include an exhaust grill having a plurality of openings (not shown).

As briefly mentioned above, a motor-cooling air pathway is provided in the extractor 10 for providing cooling air to the suction motor 178 and for removing heated cooling air (also referred to herein as "heated air") from the suction motor 178. The motor-cooling air pathway includes the inlet 48, which is fluidly upstream of the suction motor 178, and the outlet 52, which is fluidly downstream of the suction motor 178. Both the inlet 48 and the outlet 52 are in fluid communication with the ambient air outside the extractor 10.

The suction motor 178 is enclosed within a motor cover 204, which may be made of one or more separate pieces. The motor cover 204 includes at least one aperture 206, shown herein as a plurality of apertures 206, for allowing cooling air to enter the motor cover 204 and pass by the suction motor 178. A heated air outlet conduit 208 can extend from the motor cover 204 for allowing heated air to be transported away from the suction motor 178. A illustrated, the outlet conduit 208 has an inlet end 210 attached to the motor cover 204, which juts outwardly to a vertical portion 212 joined at substantially a right-angle to the inlet end 210. The vertical portion 212 of the outlet conduit 208 extends upwardly within the partition housing 32 to an outlet end 214 in fluid communication with the vent 76. The outlet end 214 can be circuitous, and can include an internal air guide 216 which leads the heated air through at least a 180° turn into the vent 76. The semi-circular protrusion 70 in the partition housing 32 can accommodate the outwardly-jutting outlet conduit 208 between the motor/fan assembly and the supply tank assembly 18.

A portion of the motor-cooling air pathway downstream of the suction motor 178 can extend near the supply tank assembly 18, such that cooling air heated by the suction motor 178 can be used to heat the fluid inside the supply tank 92. As shown herein, a heat transfer duct 218 is formed downstream of the outlet conduit 208 between the semi-circular protrusion 70 of the partition housing 32 and the internally-facing surface 108 of the supply tank 92, when the supply tank assembly 18 is seated on the base housing 30. The heat transfer duct 218 can extend between the vent 76 and the air passage 78 formed in the first platform 62. The air passage 78 can extend beneath the semi-circular protrusion 70 to the outlet 52 formed in the skirt 38 of the base housing 30 and can be at least partially defined by a duct 220 extending through the base housing.

Figure 7:
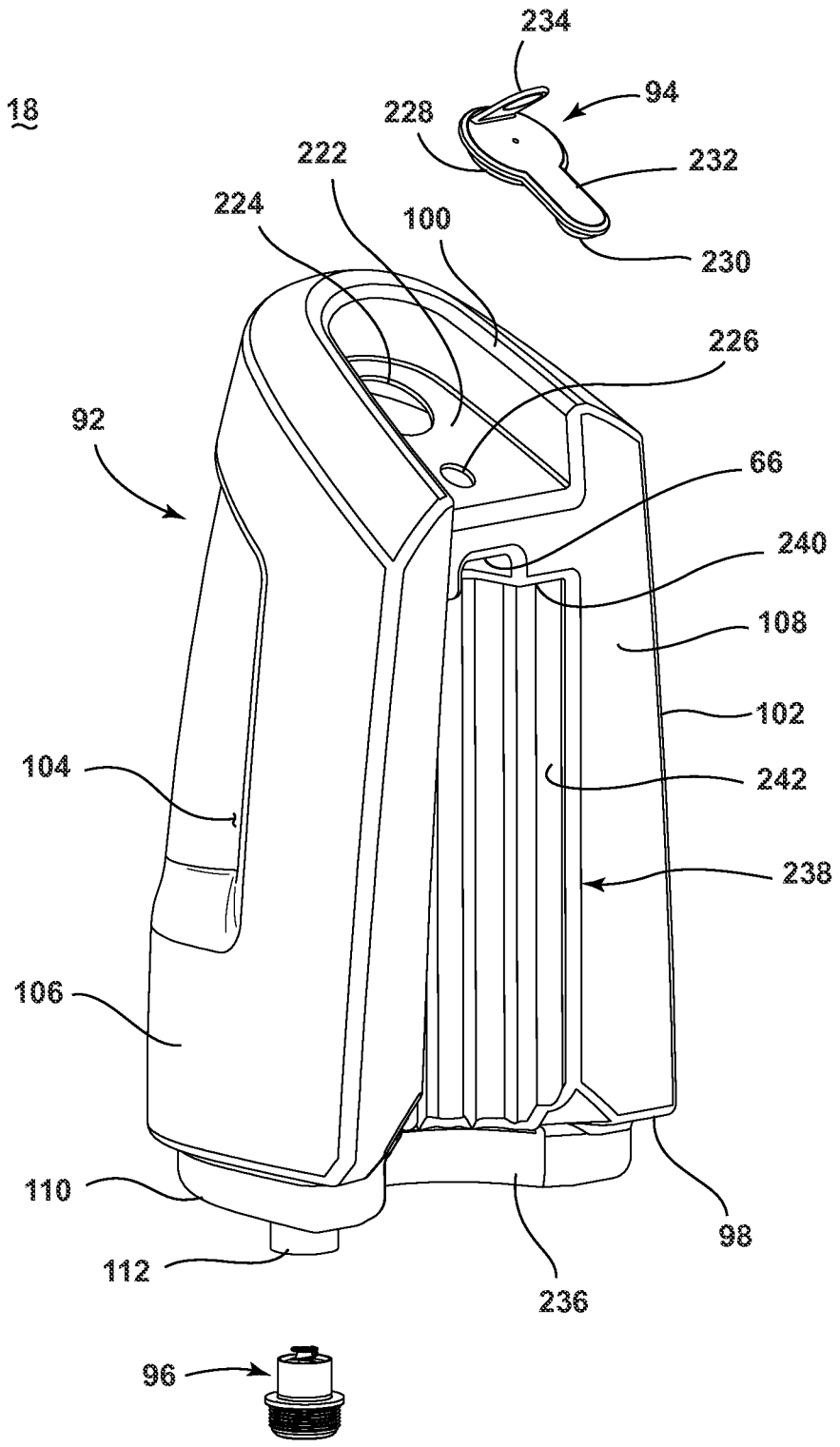
FIG. 7 is a perspective view of a fluid supply tank of the portable extraction cleaner from FIG. 1.

FIG. 7 is a perspective view of the fluid supply tank assembly 18 of the extractor 10. The recessed upper portion 100 of the supply tank 92 includes an angled face 222 which has a fill opening 224 and a cap attachment aperture 226 formed therein. The fill closure 94 comprises a cap 228 which is selectively received in the fill opening 224 to seal the fill opening 224, and an attachment plug 230 which is joined to the cap 228 by a tether 232. The attachment plug 230 can be press-fit into the cap attachment aperture 226 to retain the fill closure 94 on the supply tank 92, even when the cap 228 is removed from the fill opening 224. A grip tab 234 can be provided on the cap 228 for facilitating removal of the cap 228 from the fill opening 224. The fill closure 94 can be made from a flexible material, which permits easy assembly with the supply tank 92 and easy opening and closing of the fill opening 224 for filling or emptying the supply tank 92.

The recessed lower portion 98 comprises a semi-circular peripheral wall 236 joining the lower surface 110 to the side wall 102 in the vicinity of the internally-facing surface 108. The internally-facing surface 108 of the side wall 102 further includes a generally arcuate recessed section 238 that is defined by an upper surface 240 in which the socket 66 can be formed and a side surface 242. The recessed section 238 is open at its bottom end, and opens to the space defined by semi-circular peripheral wall 236 of the recessed lower portion 98.

Figure 8:
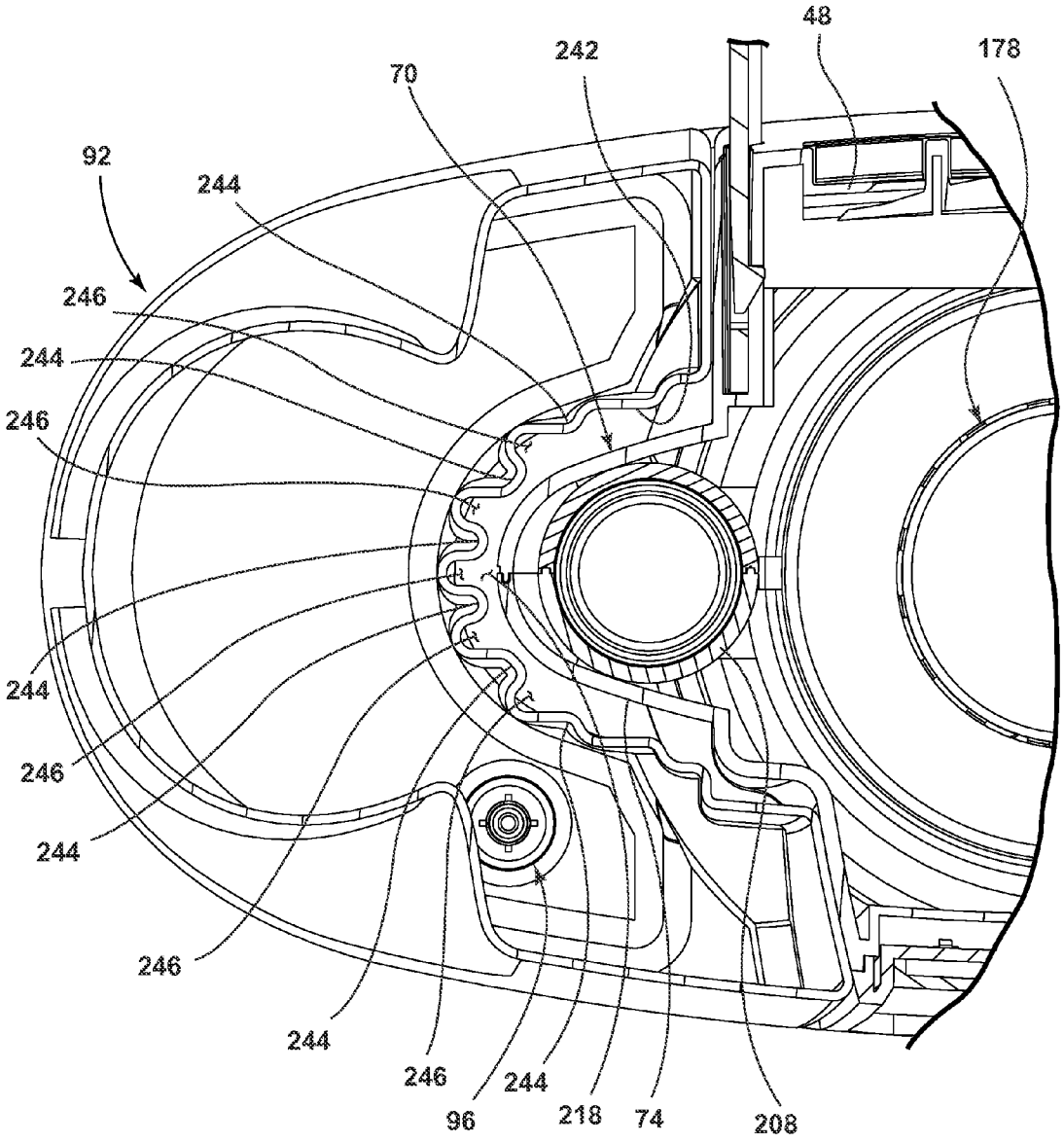
FIG. 8 is a cross-sectional view of the portable extraction cleaner through line VIII-VIII of FIG. 1.

FIG. 8 is a cross-sectional view of the extractor 10 through line VIII-VIII of FIG. 1. Heat is transferred to the fluid inside the supply tank 92 primarily through the side surface 242 to maintain or raise the temperature of the fluid. The side surface 242 can have a configuration or profile which allows heat to be transferred to the fluid inside the supply tank 92. As illustrated herein, the side surface 242 has a wavy or undulating profile that includes a plurality of undulations 244 which define channels 246 extending vertically along the side surface 242. The undulations 244 increase the effective surface area of the side surface 242, and therefore increase the effective surface area of the heat transfer duct 218, and thereby enhance heat transfer between the heated air in the heat transfer duct 218 and the fluid in the supply tank 92. Other configurations/profiles for the side surface 242 are possible, including other patterns which increase the effective surface area of the side surface 242. In an alternate embodiment, the side surface 242 can also be substantially smooth, i.e. without undulations 244. In this embodiment, some heat is still transferred between the heated air and the fluid in the supply tank 92, although not as much as when the effective surface area of the side surface 242 is increased using a non-smooth profile.

Figure 9:
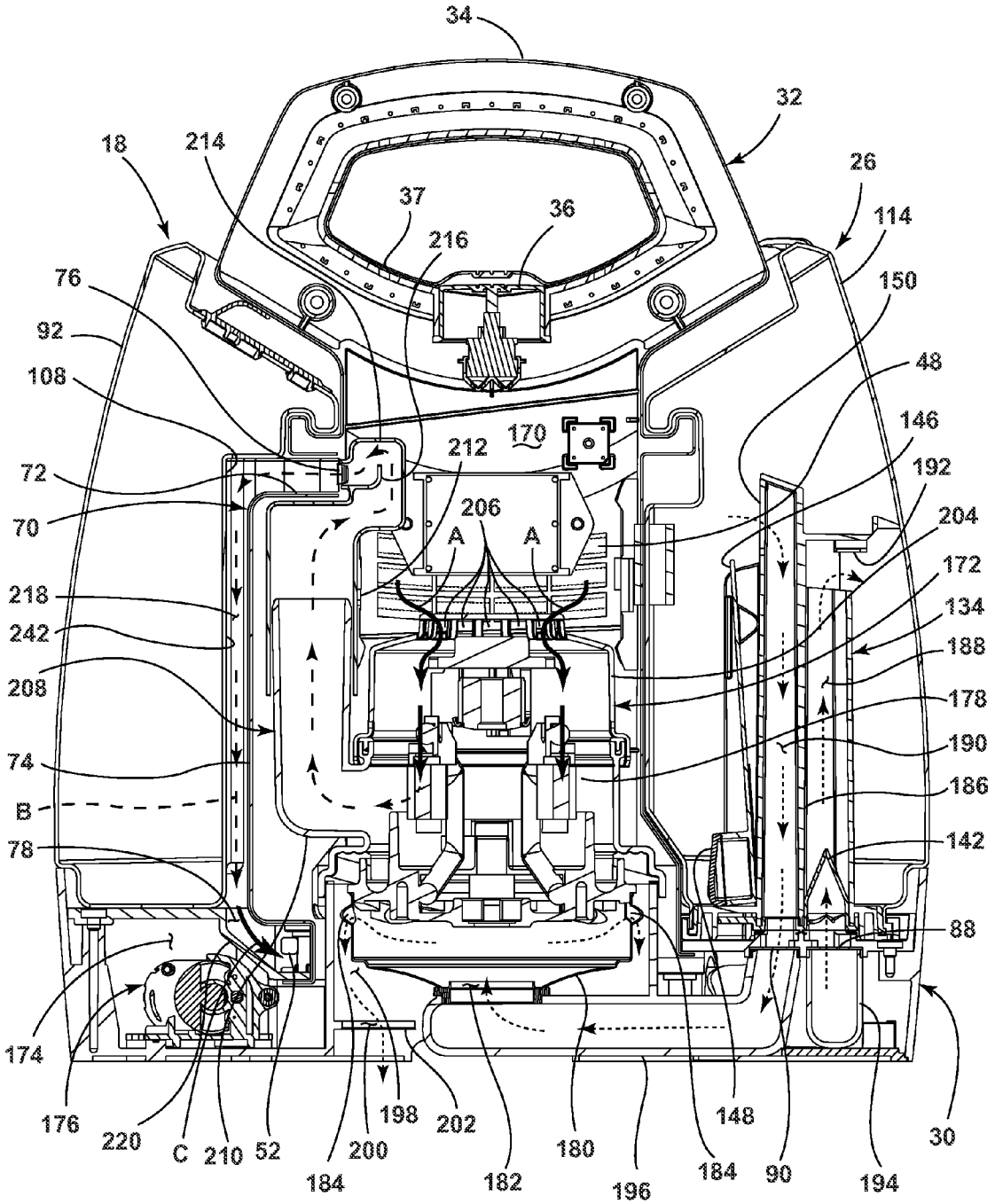
FIG. 9 is a cross-sectional view similar to FIG. 6, illustrating the flow of motor-cooling air through the portable extraction cleaner.

FIG. 9 is a cross-sectional view similar to FIG. 6, illustrating the flow of motor-cooling air through the extractor 10. In operation, the extractor 10 can be used to treat a surface to be cleaned by alternately applying a cleaning fluid to the surface from the supply tank assembly 18 and extracting the cleaning fluid from the surface into the recovery tank assembly 26. When power is applied to the suction motor 178, it drives the impeller assembly 180 to generate a suction force in the recovery tank 114 and in the recovery inlet conduit 194 coupled with the suction hose 28 and accessory tool 22 (FIG. 1). Suction force at the extraction nozzle 24 of the accessory tool 22 draws debris-containing fluid, which can contain air and liquid into the recovery tank 114, via the open duckbill valve 142 and the liquid conduit 188 of the riser tube 134. Liquid and debris in the fluid fall under the force of gravity to the bottom of the recovery tank 114. The air drawn into the recovery tank 114, now separated from liquid and debris, is drawn into the air conduit 190, and passes through the impeller inlet 182 via the recovery outlet conduit 196. The air passes through the impeller assembly 180 and through the impeller outlet(s) 184 to the exhaust passage 198, whereupon the air exits the extractor 10 through the exhaust outlet 200.

During operation of the suction motor 178, ambient cooling air enters the suction source chamber 170 through the inlet 48, and passes into the motor cover 204 via the apertures 206, as indicated by arrow A. As the cooling air passes the suction motor 178, heat from the suction motor 178 is transferred to the cooling air, thereby cooling the suction motor 178 and heating the cooling air. The heated cooling air ("heated air") exits the motor cover 204 via the outlet conduit 208, which directs the heated air into the heat transfer duct 218 via the vent 76, as indicated by arrow B. While in the heat transfer duct 218, heat from the heated air is transferred to the fluid inside the supply tank 92 through the side surface 242. As the heated air passes through the heat transfer duct, and heat is transferred to the supply tank 92, the heated air will cool. The cooled air can have the same temperature as the ambient cooling air drawn in through the inlet 48, or may be slightly warmer or cooler. The cooled air will then pass into the air passage 78, as indicated by arrow C, and exit the extractor 10 through the outlet 52.

Figure 10:
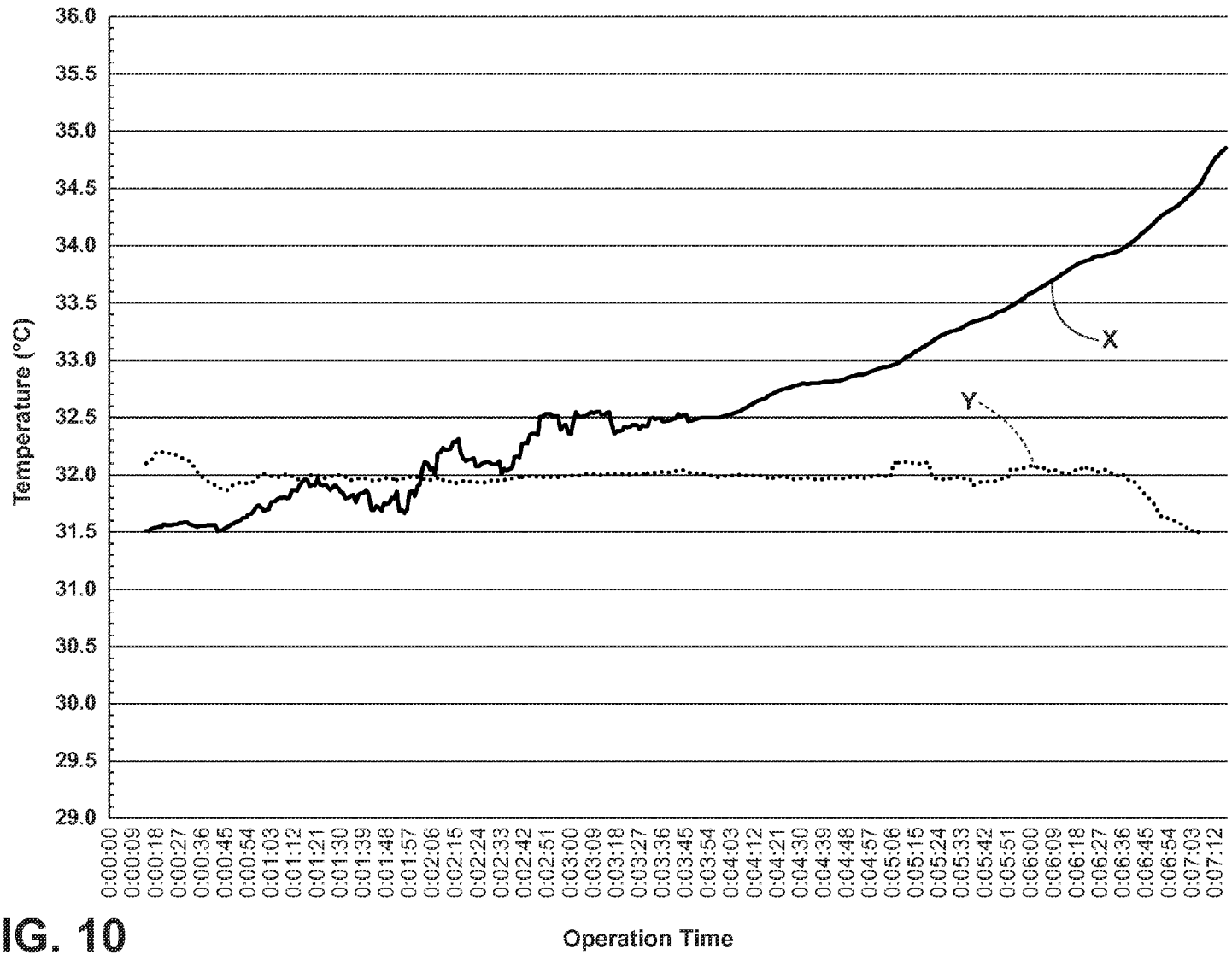
FIG. 10 is a graph illustrating the temperature of fluid within the supply tank assembly during operation of the portable extraction cleaner.

FIG. 10 is a graph illustrating the temperature of fluid within the supply tank assembly during operation of the portable extraction cleaner. In the graph, data for two different embodiments of the portable extraction cleaner are compared. Line X represents the data for the extractor 10 shown in FIGS. 1-9, which has the heat transfer duct 218 formed in part by the supply tank 92 having the plurality of undulations 244 which define the vertical channels 246. Line Y represents an extractor similar to the extractor shown in FIGS. 1-9, with the exception that the extractor was provided with a separate exhaust duct (not shown) that was configured to divert heated motor cooling air away from the heat transfer duct 218 and side surface 242 of the fluid supply tank assembly 18, rather than allowing the heated motor cooling air into the heat transfer duct 218. Instead, the separate exhaust duct of the Line Y extractor was configured to guide heated motor cooling air out of the main housing 12 and into ambient surrounding air outside the extractor 10 so as to not impart heat from the heated motor cooling air to the fluid within the supply tank assembly 18.

To compare the extractors, both extractors were operated until the supply tank 92 was empty by repeatedly applying two equal fluid dispensing strokes using the fluid distributor 20 on the tool 22 and two equal fluid extraction strokes using the extraction nozzle 24 on the tool 24. The graph of FIG. 10 shows a moving average (period=15) of the data obtained during the test. For the extractor 10 shown in FIGS. 1-9 (Line X) configured heat the fluid inside the supply tank assembly 18 by heat transfer, the temperature of the fluid within the supply tank 92 at the beginning of operation, i.e. operation time=0, was approximately 31.6° C. (88.9° F.). For the extractor represented by Line Y, the temperature of the fluid within the supply tank 92 at the beginning of operation was approximately 31.9° C. (89.4° F.). The temperature was monitored near the valve assembly 96 of the supply tank assembly 18 while the extractors were operated.

As can be seen from the graph, for the extractor 10 shown in FIGS. 1-9 and represented by Line X, the temperature of fluid within the supply tank 92 increased with operation time. This is attributed to the heat transfer between the heated air within the heat transfer duct 218 and the fluid in the supply tank 92. Also, the temperature increase was more pronounced the longer the extractor 10 was operated. Conversely, for the extractor represented by Line Y, which was configured to divert the heated air away from the heat transfer duct 218, the temperature of the fluid within the supply tank 92 did not increase and eventually dropped slightly near the end of the operation time. As shown in FIG. 10, the temperature increase was several degrees for the first embodiment (Line X), reaching a high of approximately 35° C. near seven minutes of operation time. The temperature increase seen in Line X and not line Y is attributable to heat transfer from the heated motor-cooling air in the heat transfer duct 218 to the supply tank 92. Moreover, increasing the effective surface area of the heat transfer duct 218 by incorporating undulations 244 and vertical channels 246 on the first sidewall 60 further enhances heat transfer between the heated air in the heat transfer duct 218 and the fluid in the supply tank 92.

Figure 11:
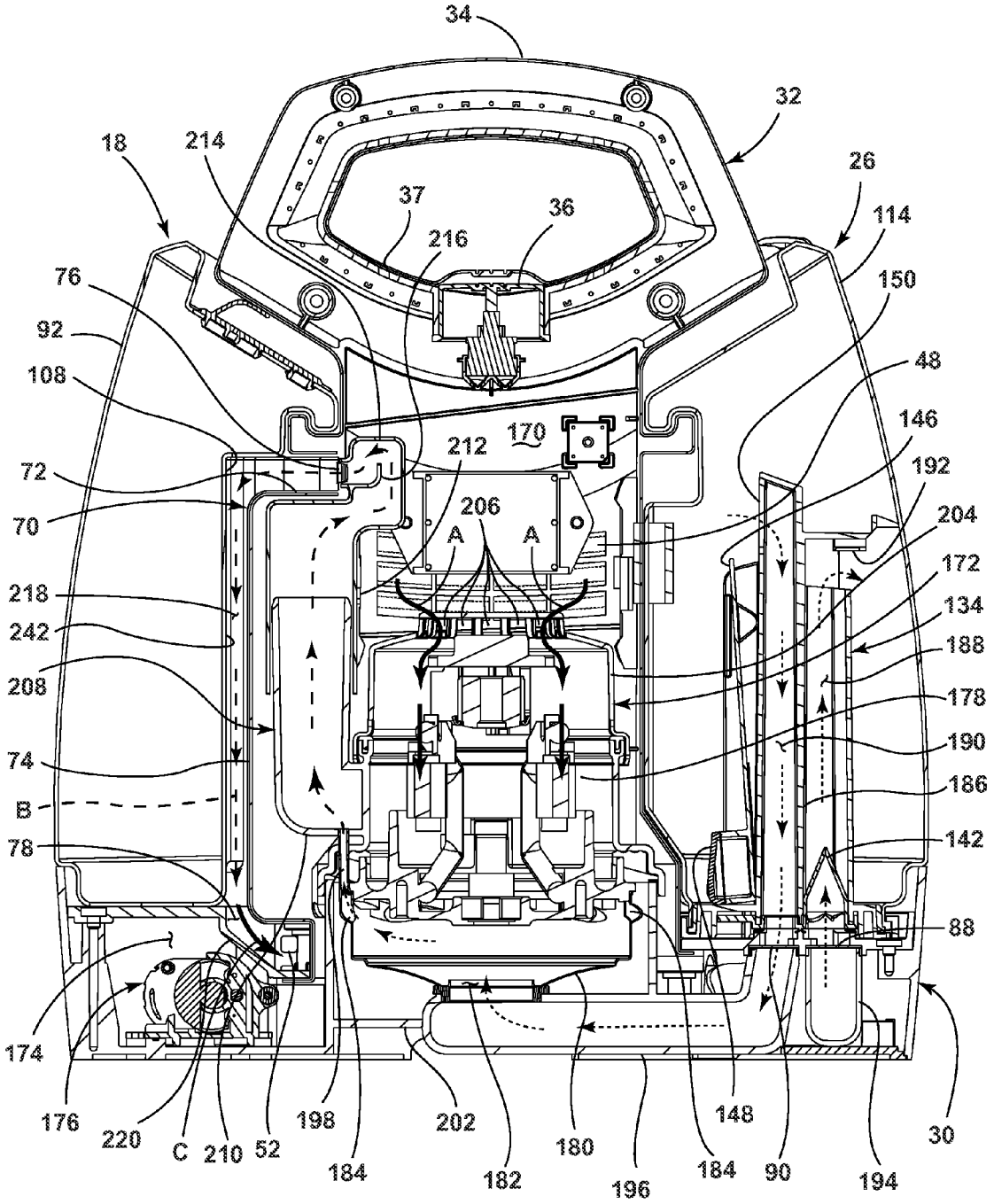
FIG. 11 is a cross-sectional view of a portable extraction cleaner according to a second embodiment of the invention.

FIG. 11 is a cross-sectional view of a portable extraction cleaner 10 according to a second embodiment of the invention, in which like elements are referred to with the same referenced numerals used for the first embodiment. In the second embodiment, the heat transfer duct 218 with the undulating profile can be used to transfer heated exhaust air, instead of or in addition to heated motor cooling air, past the supply tank 92. In this configuration, the impeller outlet(s) 184 are in fluid communication with an inlet to the heat transfer duct 218, rather than exhaust outlet 200, which can be eliminated. The exhaust passage 198 in this case is fluidly formed between the impeller outlet(s) 184 and the heat transfer duct 218.

In operation, when power is applied to the suction motor 178, the suction motor 178 drives the impeller assembly 180 to generate a suction force in the recovery tank 114 and in the recovery inlet conduit 194 coupled with the suction hose 28 and accessory tool 22. The air drawn into the recovery tank 114, separated from liquid and debris, is drawn into the air conduit 190, and passes through the impeller inlet 182 via the recovery outlet conduit 196. The air is heated by compression within the impeller assembly 180 and friction against the blades of the impeller. There may also be some heat transfer to the air from the suction motor 178. The air passes through the impeller assembly 180 and through the impeller outlet(s) 184 to the heat transfer duct 218. While in the heat transfer duct 218, heat from the heated exhaust air is transferred to the fluid inside the supply tank 92 through the side surface 242. Increasing the effective surface area of the heat transfer duct 218 by incorporating the undulations 244 and vertical channels 246 enhance heat transfer between the heated exhaust air in the heat transfer duct 218 and the fluid in the supply tank 92. As the heated exhaust air passes through the heat transfer duct, and heat is transferred to the supply tank 92, the heated exhaust air will cool. The cooled exhaust air can have the same temperature as the ambient air drawn in through the accessory tool 22, or may be slightly warmer or cooler. The cooled exhaust air will then pass into the air passage 78, and exit the extractor 10 through the outlet 52 as indicated by arrow C.

In this embodiment, the motor-cooling air pathway can be isolated from the exhaust air pathway, including the heat transfer duct 218. During operation of the suction motor 178, ambient cooling air enters the suction source chamber 170 through the inlet 48, and passes into the motor cover 204 via the apertures 206, as indicated by arrow A. The cooling air exits the motor cover 204 and can be directed out of the extractor 10 via an outlet (not shown). Alternatively, a separate heat transfer duct (not shown) can be provided for directing the heated motor cooling air past the supply tank 92. Thus, the fluid inside the supply tank 92 can be heated by both heated exhaust air and heated motor cooling air.

The disclosed embodiments are representative of preferred forms of the invention and are intended to be illustrative rather than definitive of the invention. The illustrated upright extractor is but one example of the variety of deep cleaners with which this invention or some slight variant can be used. Reasonable variation and modification are possible within the forgoing disclosure and drawings without departing from the scope of the invention which is defined by the appended claims.

What is claimed is:

1. A surface cleaning apparatus for cleaning a surface, comprising:

a housing at least partially defining an air pathway;

a fluid delivery system having a supply tank provided with the housing for storing cleaning fluid and a fluid distributor for delivering the cleaning fluid from the supply tank to the surface;

a motor/fan assembly provided within the air pathway for generating an airflow through the air pathway wherein the motor/fan assembly transfers heat to air moving through the air pathway and removes heated air from the air pathway, the air pathway having an inlet upstream of the motor/fan assembly and an outlet downstream of the motor/fan assembly; and a duct downstream of the motor/fan assembly and upstream of the outlet and having a section in heat exchange relationship with the supply tank, with the section of the duct having an undulating profile providing an increased surface area in heat exchange relationship with the supply tank to heat the supply of cleaning fluid in the supply tank by heat transfer from the heated air;

wherein the section of the duct having the undulating profile is at least partially formed by a side wall of the supply tank and an exterior wall of the housing.

2. The surface cleaning apparatus of claim 1, wherein the side wall of the supply tank comprises the undulating profile.

3. The surface cleaning apparatus of claim 2, wherein the undulating profile comprises a plurality of elongated channels formed in the side wall of the supply tank.

4. The surface cleaning apparatus of claim 2, wherein the duct is further at least partially formed by a section extending interiorly though the housing.

5. The surface cleaning apparatus of claim 4, wherein the duct further comprises an internal air guide which leads the heated air through at least one 180° turn.

6. The surface cleaning apparatus of claim 1, wherein the air pathway comprises a motor-cooling air pathway, and the motor/fan assembly comprises a motor provided within the motor-cooling air pathway, between the inlet and outlet, for providing cooling air to the motor and for removing heated cooling air from the motor, and the duct is downstream of the motor.

7. The surface cleaning apparatus of claim 6, wherein the motor is enclosed within a motor cover, and the motor cover includes at least one aperture for allowing cooling air to enter the motor cover and pass by the motor.

8. The surface cleaning apparatus of claim 6 and further comprising a fluid recovery system defining an extraction pathway for removing the delivered cleaning fluid and debris from the surface and having a recovery tank storing the recovered cleaning fluid and debris.

9. The surface cleaning apparatus of claim 8, wherein the extraction pathway is fluidly isolated from the motor-cooling air pathway.

10. The surface cleaning apparatus of claim 8, wherein the housing carries the fluid delivery system and the fluid recovery system.

11. The surface cleaning apparatus of claim 8 and further comprising a hand-held accessory tool in fluid communication with the supply tank, wherein the fluid distributor is provided on the hand-held accessory tool.

12. The surface cleaning apparatus of claim 11, wherein the fluid recovery system comprises an extraction nozzle provided on the hand-held accessory tool in fluid communication with the recovery tank.

13. The surface cleaning apparatus of claim 8, wherein the housing comprises a base and a partition extending upwardly from the base, and the supply and recovery tanks rest on the base and are separated by the partition.

14. The surface cleaning apparatus of claim 13, wherein the partition comprises a carry handle at an upper portion thereof which facilitates carrying the surface cleaning apparatus.

15. The surface cleaning apparatus of claim 13, wherein the inlet for the air pathway is provided in the partition.

16. The surface cleaning apparatus of claim 15, wherein the outlet for the air pathway is provided in the base.

17. A surface cleaning apparatus for cleaning a surface, comprising:

a housing at least partially defining an air pathway;

a fluid delivery system having a supply tank provided with the housing for storing cleaning fluid and a fluid distributor for delivering the cleaning fluid from the supply tank to the surface;

a fluid recovery system defining an extraction pathway for removing the delivered cleaning fluid and debris from the surface and having a recovery tank storing the recovered cleaning fluid and debris;

a motor/fan assembly provided within the air pathway for generating an airflow through the air pathway wherein the motor/fan assembly transfers heat to air moving through the air pathway and removes heated air from the air pathway, the air pathway having an inlet upstream of the motor/fan assembly and an outlet downstream of the motor/fan assembly; and a duct downstream of the motor/fan assembly and upstream of the outlet and having a section in heat exchange relationship with the supply tank, with the section of the duct having an undulating profile providing an increased surface area in heat exchange relationship with the supply tank to heat the supply of cleaning fluid in the supply tank by heat transfer from the heated air;

wherein the housing comprises a base and a partition extending upwardly from the base, and the supply and recovery tanks rest on the base and are separated by the partition;

wherein the partition comprises a carry handle at an upper portion thereof which facilitates carrying the surface cleaning apparatus.

18. A surface cleaning apparatus for cleaning a surface, comprising:

a housing at least partially defining an air pathway;

a fluid delivery system having a supply tank provided with the housing for storing cleaning fluid and a fluid distributor for delivering the cleaning fluid from the supply tank to the surface;

a fluid recovery system defining an extraction pathway for removing the delivered cleaning fluid and debris from the surface and having a recovery tank storing the recovered cleaning fluid and debris;

a motor/fan assembly provided within the air pathway for generating an airflow through the air pathway wherein the motor/fan assembly transfers heat to air moving through the air pathway and removes heated air from the air pathway, the air pathway having an inlet upstream of the motor/fan assembly and an outlet downstream of the motor/fan assembly; and a duct downstream of the motor/fan assembly and upstream of the outlet and having a section in heat exchange relationship with the supply tank, with the section of the duct having an undulating profile providing an increased surface area in heat exchange relationship with the supply tank to heat the supply of cleaning fluid in the supply tank by heat transfer from the heated air;

wherein the housing comprises a base and a partition extending upwardly from the base, and the supply and recovery tanks rest on the base and are separated by the partition;

wherein the inlet for the air pathway is provided in the partition.

* * * * *